United States Patent [19]

Geller et al.

[11] Patent Number: 4,787,463

[45] Date of Patent: Nov. 29, 1988

[54] METHOD AND APPARATUS FOR INSTALLMENT OF UNDERGROUND UTILITIES

[75] Inventors: Edward Geller, Mercer Island; Mike Kirby, Vashon; John Mercer, Kent; Tom O'Hanlon, Tacoma; Jim Reichman, Issaquah; Ken Theimer, Auburn; Robert Svendsen, Seattle, all of Wash.

[73] Assignee: FlowMole Corporation, Kent, Wash.

[21] Appl. No.: 183,414

[22] Filed: Apr. 18, 1988

Related U.S. Application Data

[63] Continuation of Ser. No. 20,545, Mar. 3, 1987, abandoned, which is a continuation of Ser. No. 709,046, Mar. 7, 1985, Pat. No. 4,674,579.

[51] Int. Cl.[4] ..... E21B 7/08; E21B 7/18; E21B 10/60; E21B 47/024

[52] U.S. Cl. ..... 175/45; 175/61; 175/67; 175/75; 175/424; 405/184

[58] Field of Search ..... 175/26, 45, 61, 62, 175/67, 75, 424; 405/184

[56] References Cited

U.S. PATENT DOCUMENTS

| | | | |
|---|---|---|---|
| 94,854 | 9/1869 | Whartnaby . | |
| 172,529 | 1/1876 | Waring . | |
| 700,430 | 5/1902 | Lane . | |
| 1,859,490 | 5/1932 | Atkinson | 175/61 |
| 2,018,007 | 10/1935 | Brewster | 175/75 |
| 2,181,284 | 11/1939 | Potts . | |
| 2,196,940 | 4/1940 | Potts . | |
| 2,324,102 | 7/1943 | Miller et al. . | |
| 2,336,333 | 10/1943 | Zublin | 175/290 |
| 2,342,498 | 2/1944 | Spang . | |
| 2,350,986 | 6/1944 | Collins . | |
| 2,500,267 | 3/1950 | Zublin | 175/75 |
| 2,783,972 | 3/1957 | Fehlmann | 175/424 |
| 2,903,239 | 9/1959 | Standridge . | |
| 3,461,979 | 8/1969 | Newfarmer | 175/45 |
| 3,529,682 | 9/1970 | Coyne et al. | 175/45 |
| 3,536,151 | 10/1970 | Aarup | 175/422 |
| 3,589,454 | 6/1971 | Coyne | 175/26 |
| 3,599,733 | 8/1971 | Varley | 175/67 X |
| 3,746,106 | 7/1973 | McCullough et al. | 175/45 |
| 3,746,108 | 7/1973 | Hall | 175/67 X |
| 3,853,185 | 12/1974 | Dahl et al. | 175/45 |
| 3,878,903 | 4/1975 | Cherrington | 175/45 |
| 3,907,045 | 9/1975 | Dahl et al. | 175/45 |
| 4,144,941 | 3/1979 | Ritter | 175/19 |
| 4,306,627 | 12/1981 | Chueng et al. | 175/67 X |
| 4,361,192 | 11/1982 | Trowsdale | 175/45 |
| 4,438,820 | 3/1984 | Gibson | 175/45 |
| 4,445,578 | 5/1984 | Millheim | 175/45 |
| 4,452,075 | 6/1984 | Bockhorst et al. | 175/45 |

*Primary Examiner*—Stephen J. Novosad
*Attorney, Agent, or Firm*—Flehr, Hohbach, Test, Albritton & Herbert

[57] ABSTRACT

A method and apparatus for installing underground utilities using an offset head fluid jet drilling and reaming apparatus. The drill is maneuverable and provides means for remote sensing of orientation and depth. Embodiments are illustrated with single and multiple jet cutting orifices.

17 Claims, 5 Drawing Sheets

METHOD AND APPARATUS FOR INSTALLMENT OF UNDERGROUND UTILITIES

This is a continuation of application Ser. No. 020,545, filed Mar. 3, 1987, now abandoned, which is a continuation of Ser. No. 709,046, filed Mar. 7, 1985, now U.S. Pat. No. 4,674,579.

FIELD OF THE INVENTION

This invention pertains to the drilling of soft materials, more particularly to drilling materials such as earth with the use of high pressure fluid, with still greater particularity to the drilling of soil for the purpose of installing utilities.

BACKGROUND OF INVENTION

Due to aesthetic and safety considerations, utilities such as electricity, telephone, water and gas lines are often supplied from underground lines. The most common means of installing such lines is the cut and cover technique, where a ditch is first dug in the area where the line is desired. The utility line is then installed in the ditch and the ditch covered. This technique is most satisfactory for new construction.

In built up areas the cut and cover technique has a number of problems. First, a ditch often cannot be dug without disturbing existing structures and traffic areas. Digging the trench also creates a greatly increased chance of disturbing existing utility lines. Finally, the trench after refilling, often remains as a partial obstruction to traffic.

For the above reasons, a number of means of boring through unconsolidated material such as soil have been proposed. To date none of the boring methods have met with widespread commerical adoption for a number of reasons.

SUMMARY OF THE INVENTION

The invention provides an economical method of drilling through unconsolidated material by the use of jet cutting techniques. The invention also provides for guidance of the tool by electronic means to either form a hole in a predetermined path or to follow an existing utility line.

The invention includes a source of high pressure fluid. The fluid is conveyed to a swivel attached to a section of pipe. A motor allows rotation of the pipe. The pipe is connected to as many sections of pipe as required by means of streamlined couplings. At the end of the string of pipe is a nozzle or combination of nozzles with a small bend relative to the string of pipe. The nozzle may also be equipped with a radio transmitter and directional antenna. A receiver allows detection of the location of the nozzle.

The tool is advanced by rotating the motor and pushing. To advance around a curve, rotation is stopped and the drill oriented so that the bent tip is pointed in the proper direction. The tool is then pushed without rotation until the proper amount of curvature is obtained. During this push, a slight oscillation of the drill can be used to work the tip around rocks and increase cutting. Continued straight advancement is obtained using rotation.

DESCRIPTION OF THE PREFERRED EMBODIMENT

Figure 1:
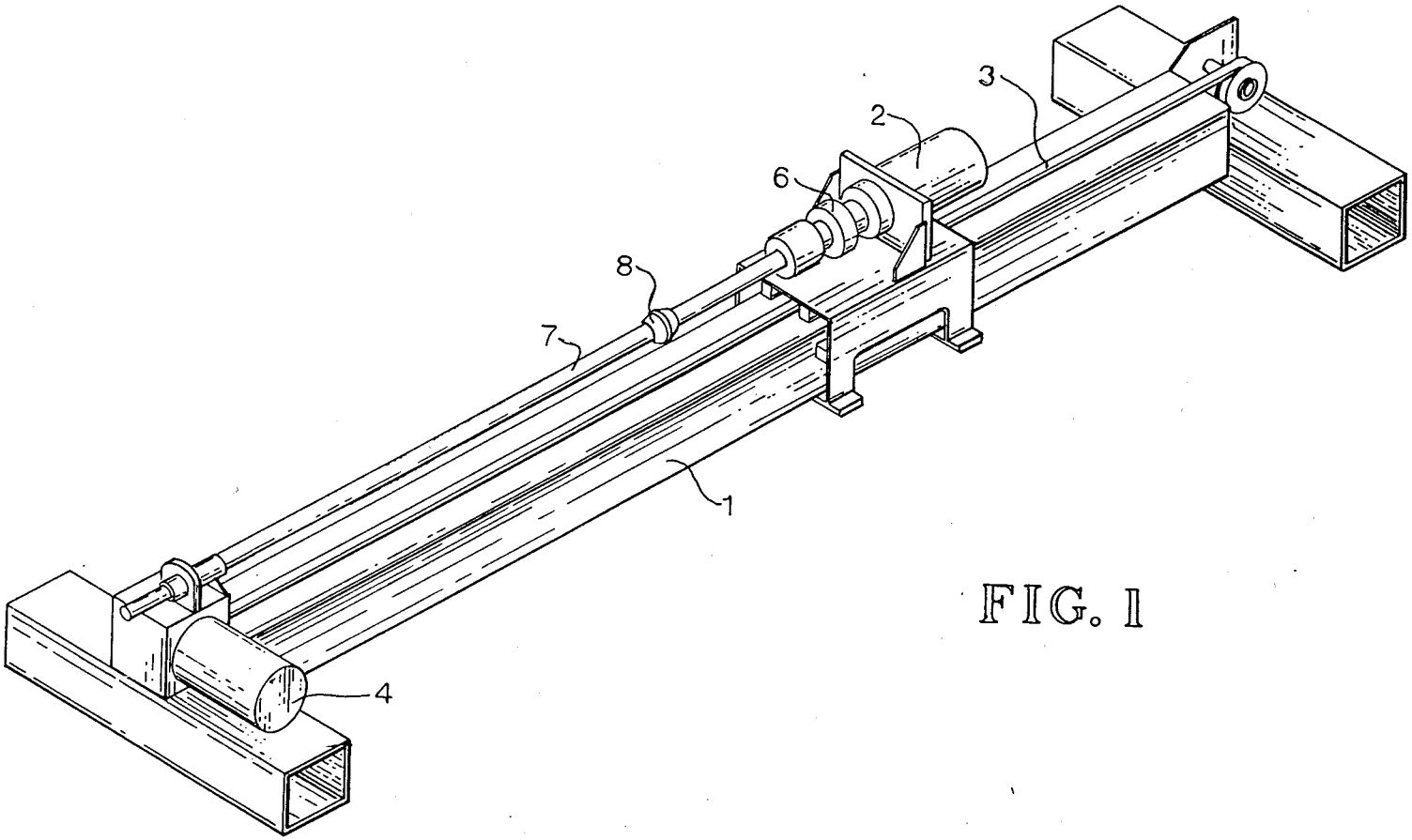
FIG. 1 is a perspective view of the advancing frame of the invention.

FIG. 1 is a perspective view of the advancing frame end of the system. An advancing frame 1 contains the stationary elements of the system. Frame 1 is inclinable to any convenient angle for insertion of the drill. A motor 2 is mounted to frame 1 with a provision for lateral movement. In this embodiment, motor 2 is advanceable by means of a chain 3 which is connected to an advancement motor 4. Activation of motor 4 advances motor 2. A high pressure swivel 6 is connected to the shaft of motor 2. A pipe 7 is also connected to swivel 6 by means of a coupling 8. Swivel 6 allows the supply of high pressure fluid to pipe 7 while motor 2 is rotating pipe 7. Activation of motor 2 causes pipe 7 to rotate. In this embodiment swivel 6 is supplied with fluid at a pressure of from 1500 to 4000 pounds per square inch. The fluid may be water or a water/betonite slurry or other suitable cutting fluid. The supply is from a conventional high pressure pump (not shown).

Figure 2:
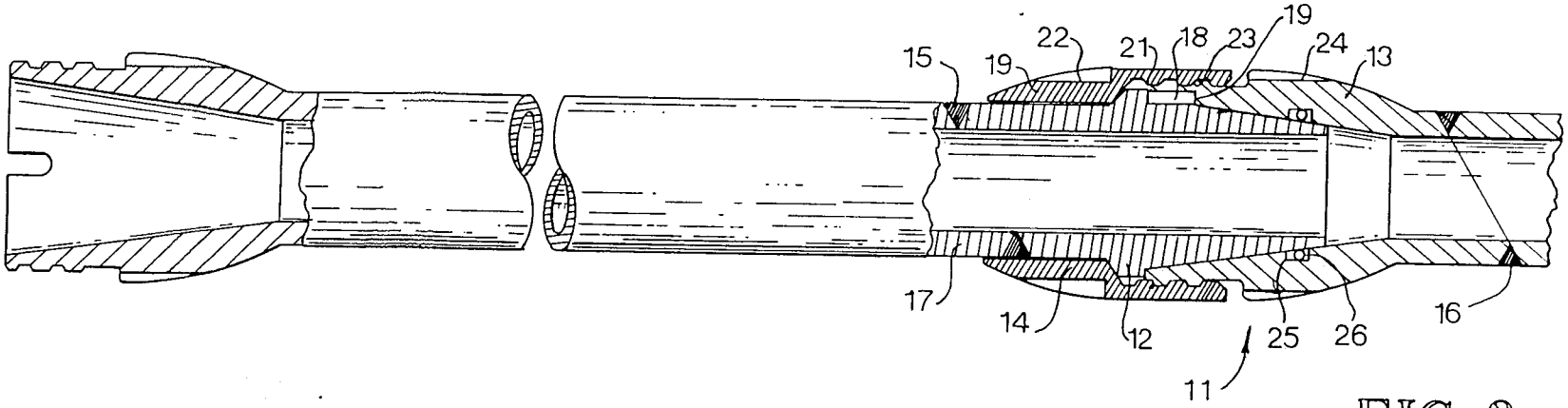
FIG. 2 is a partial section elevation view of a section of drill pipe.

FIG. 2 is a partial section elevation view of a section of a drill pipe 11. Each section of drill pipe 11 includes a male end 12 and a female end 13. In this embodiment the ends 12, 13 are attached by welds 15, 16 at about a 45 degree angle to increase fatigue life, respectively, to a straight pipe section 17. Ends 12 and 13 include a 6 degree tapered fit to hold torque and provide ease of disassembly. Male end 12 include a key 18 to align with a slot 19 in female end 13 to lock sections together and allow rotational forces to be transmitted down a drill string. A streamlined nut 14 encloses male end 12. Nut 14 includes a series of internal threads 21 on one end and an external hex 22 on the other end. Threads 21 of nut 14 are threadably engageable with external threads 23 on the female end 13. Female end 13 is further equipped with a hex 24 for a wrench. Finally, female end 13 provides a notch 25 which will accept an O ring 26 to seal female end 13 to male end 12. In operation successive length of drill line may be formed by attaching male ends 12 to female ends 13 and tightening nut 14 to provide a leakproof, streamlined joint that transmits rotational motion in either direction.

Figure 3:
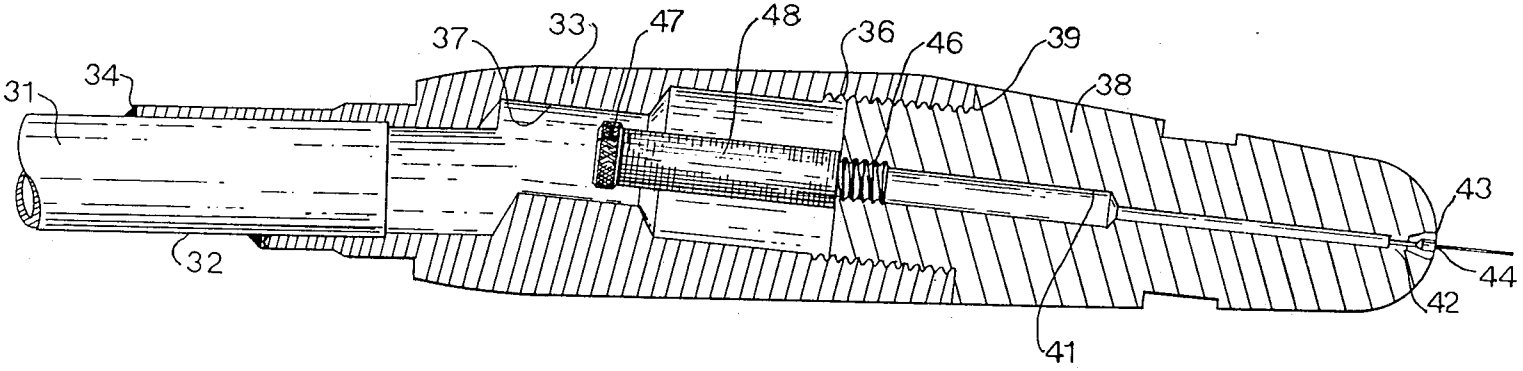
FIG. 3 is a section view of a nozzle usable with the invention.

FIG. 3 is a section elevation view of a nozzle used with the invention. A section of drill pipe 31 having a female end (not shown) as in FIG. 2 is provided with a blank end 32 to which the female half 33 of the nozzle body is attached. Attachment may be by means of welds 34. The end of half 33 not attached to pipe 31 is provided with internal threads 36. Threads 36 axis is inclined at an angle from the axis of pipe 31. In this case the angle is approximately 5 degrees. The internal cavity 37 of half 33 is accordingly offset. A male half 38 of the nozzle body is threadably attachable to female half 33 by means of external threads 39. Male half 38 is further provided with an internal cavity 41 which is colinear with threads 36. The end of cavity 41 furthest from pipe 31 is provided with internal threads 42 to accept a jewel nozzle mount 43. Jewel nozzle mount provides an orifice of fluid resistant material such as synthetic sapphire from which a cutting jet 44 can emerge. The other end of cavity 41 is provided with internal threads 46 to accept a strainer support 47 which provides a support for a strainer 48. A 50 mesh screen has been found effective for use as strainer 48. The result is that if pipe 31 is rotated and supplied with high pressure fluid a rotating cutting jet 44 emerges from jewel mount 43 at about a 5 degree inclination to its axis of rotation.

In operation the nozzle is rotated by rotation of drill pipe 31 through the drill string by motor 2 in FIG. 1. This produces a straight hole. This rotation is accompanied by pushing forward of the nozzle through the action of drill pipe 31 by action of Motor 4 in FIG. 1. To advance around a curve male half 38 is pointed in the direction in which the curve is desired and advanced without rotation. Since half 38 is offset at a 5 degree angle, the resulting hle will be curved. Half 38 can be oscillated to work around rocks. To resume a straight path rotation is restarted by activating motor 2.

Figure 4:
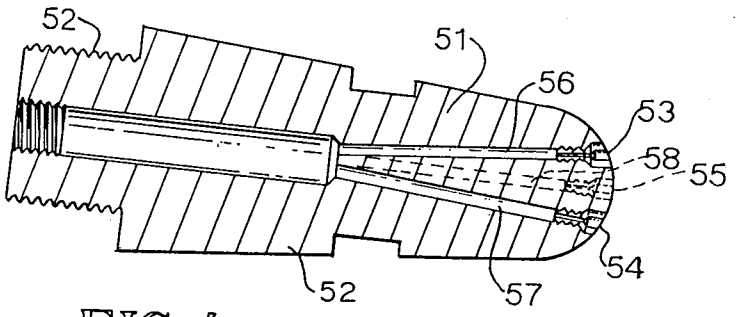
FIG. 4 is a second embodiment of a nozzle usable with the invention.

FIG. 4 is a section elevation view of a second embodiment of the male half of the nozzle. Male half 57 is provided with a threaded end 52 joinable to the female half of the FIG. 3 embodiment. The other end is provided with three jewel mounts 53, 54, 55 which are arranged inan equilateral triangle and equipped with passages 56, 57, 58 connecting them to a source of high pressure fluid. This embodiment may be more suitable for certain soil types. As many as eight nozzles may be necessary depending on soil conditions.

Figure 5:
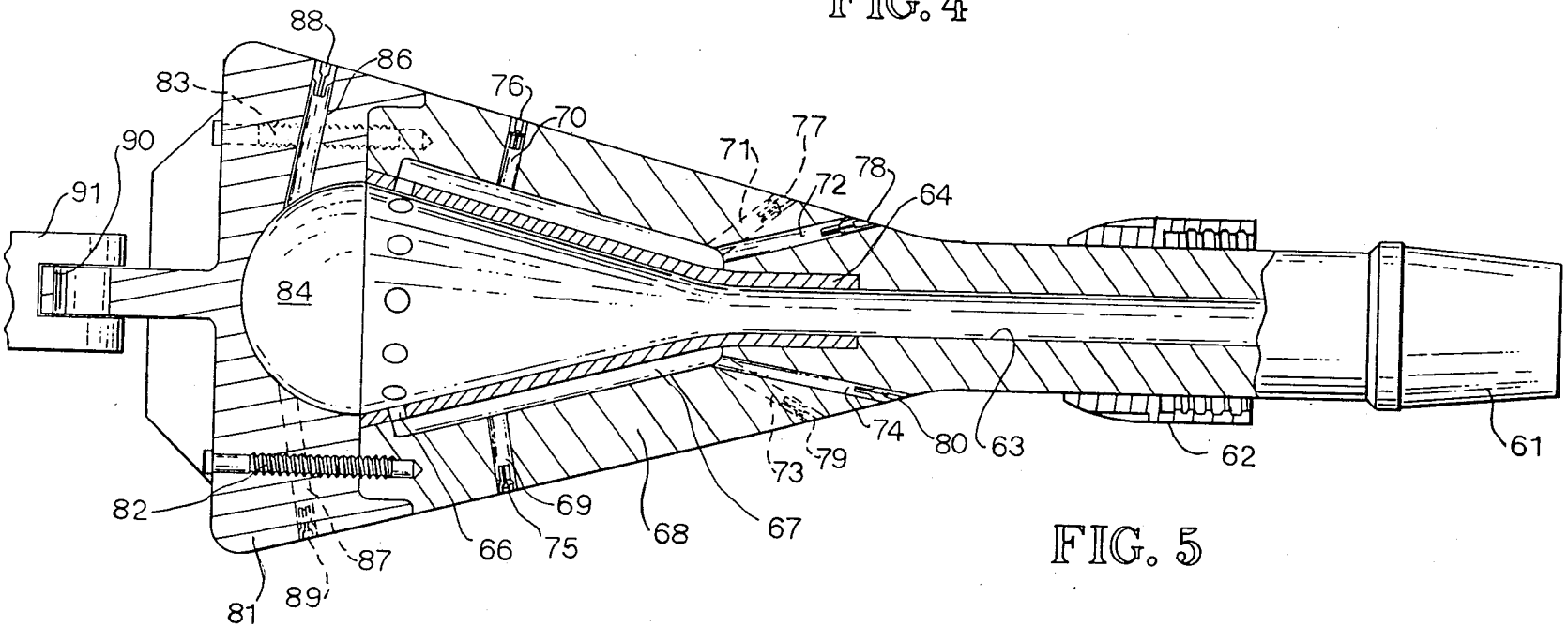
FIG. 5 is a partial section elevation view of a reamer for the invention.

FIG. 5 is a section elevation view of a reamer for use with the invention. The reamer is pulled back through the hole drilled by the drill to increase its diameter for larger utilities. A female coupling 61 is at one end of the reamer and a nut 62 for attachment to a section of drill pipe as in FIG. 2 (not shown). An internal passage 63 communicates with the interior of the drill pipe. A baffle cone 64 having a plurality of exit holes 66 lies in passage 63. Fluid flow is thus up the drill pipe through female coupling 61 into passage 63 up baffle cone 64 through holes 66 and into the area 67 between baffle cone 64 and the interior of the reamer body 68. A plurality of passages 69–74 communicate to the exterior of the reamer body 68. Each passage 69–74 may be equipped with a jewel orifices 75–80. An end cap 81 is attached to reamer body 68 by bolts 82, 83. End cap 81 is provided with an internal cavity 84 which communicates with cavity 63 in reamer body 68. Cavity 84 includes passages 86, 87 with corresponding jet orifices 88, 89 to provide additional reaming action. Finally, cap 81 includes an attachment point 90 for attachment of a shackle 91 to pull a cable back through the hole.

To ream a hole the nozzle is removed after the hole is drilled and the reamer attached by tightening nut 62. Fluid is then pumped down the drill pipe causing cutting jets to emerge from orifices 75–80 and 88 and 89. The drill pipe is then rotated and the reamer drawn back down the hole pulling a cable. The hole is thus reamed to the desired size and the utility line is simultaneously drawn back through the hole.

Figure 6:
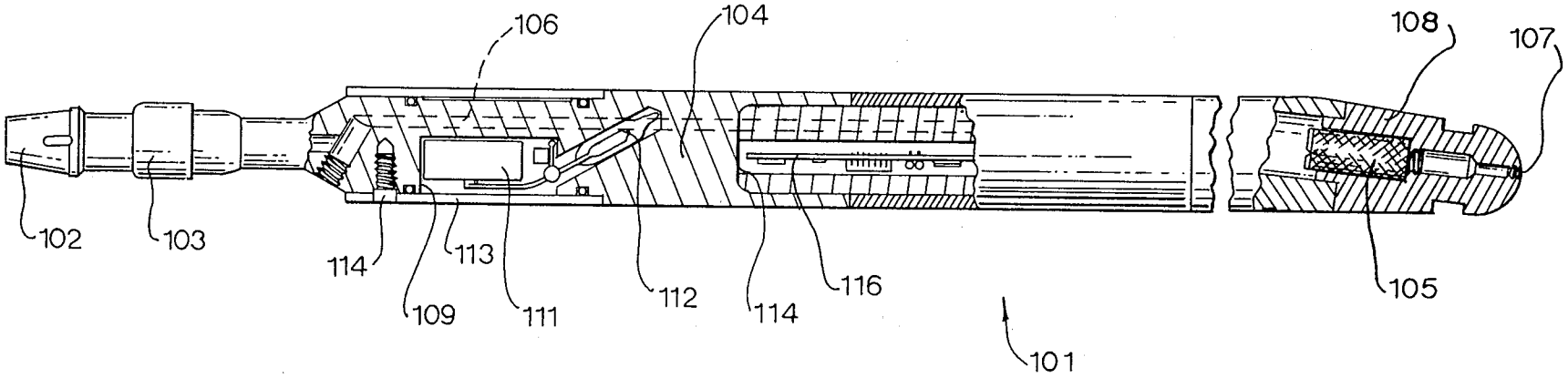
FIG. 6 is a partial section elevation view of a third embodiment of a nozzle for the invention.

FIG. 6 is a partial section elevation view of a nozzle incorporating a guidance system of the invention. Nozzle 101 includes a female connector 102 and nut 103 similar to the FIG. 3 embodiment. A body 104 is connected to connector 103 and includes a passage 106 to allow cutting fluid to flow to an orifice 107 after passing a screen 105 in a tip 108 similar to that in the FIG. 3 embodiment. Body 104 includes a cavity 109 for a battery 111 and a mercury switch 112. Access to cavity is via a sleeve 113 attached by screw 114. Body 104 further includes a second cavity 114 for a circuit board 116. Circuit board 116 includes a transmitter and dipole antenna capable of producing a radio frequency signal when powered by battery 111. A frequency of 83 KHz has been found satisfactory. The antenna is preferably a ferrite rod wrapped with a suitable number of turns of wire. Mercury switch 112 is connected in such a manner to switch off the transmitter whenever the tip 103 is inclined upwards. This allows a person on the surface to sense the inclination of the tip by measuring the angle of rotation that the transmitter switches on and off.

A number of methods may be used to guide the system. If the FIG. 3 or 4 nozzles are used, a cable tracer transitter can be attached to the drill string. A cable tracer receiver is then used to locate the tool body and drill string. In tests a commercial line tracer producing a CW signal at 83 KHz was used. This tracer is a product of Metrotech, Inc. and called model 810. If the FIG. 6 nozzle is used the transmitter is contained in the nozzle and no transmitter need be attached to the drill string. Some tracers provide depth information as well as position. Depth can also be determined accordingly by introducing a pressure transducer through the drill string to the tip. The pressure is then determined relative to the fluid supply level. Such a method provides accuracy of plus or minus one inch.

Figure 7:
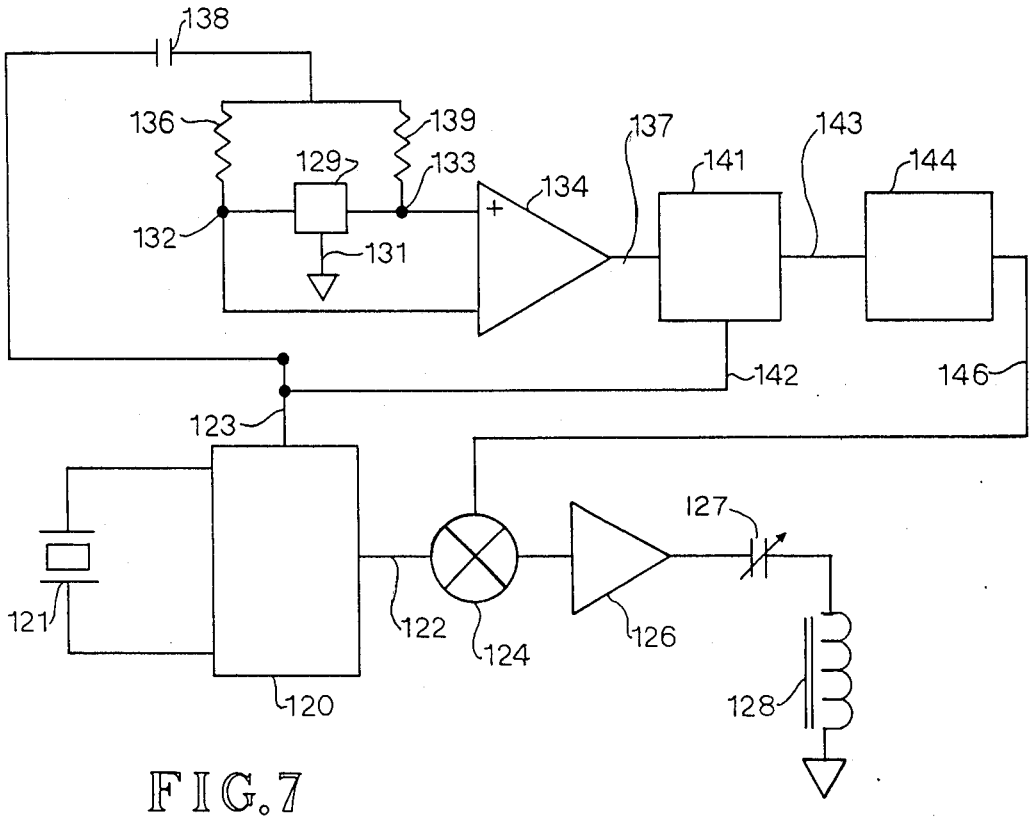
FIG. 7 is a schematic view of the transmitter of the invention.

FIG. 7 is a schematic view of the transmitter of the invention. An oscillator 120 controlled by a crystal 121 producing an 80 KHz signal at 122 and a 1.25 KHz signal at 123. The 80 KHz signal passes to a modulator 124 which allows amplitude modulation of the signal and a buffer amplifier 126. The signal is then connected to a variable antenna tuning capacitor 127 to a ferrite dipole antenna 128. While no power connections are shown, it is assumed that all components are supplied with suitable working voltage.

If one wants to determine the pitch of the drilling head, it is provided with an electrolytic transducer 129. The common electrode 131 of transducer 129 is grounded and the other electrodes 132, 133 are connected to the inputs of a differential amplifier 134. Electrodes 132, 133 are also connected via resistors 136, 139 and capicator 138 to the 1.25 KHz output of oscillator 120. The output 139 of differential amplifier 134 is connected to the input of a lock-in amplifier 141 which also receives a reference signal via electrode 142. The result is a DC signal at 143 that varies with the pitch of the head. Signal 143 in turn drives a voltage to frequency converter 144, the output 146 of which is used to modulate the signal at 122. The final result is an amplitude modulated signal from antenna 128 with modulated frequency proportional to the pitch of the head.

Figure 8:
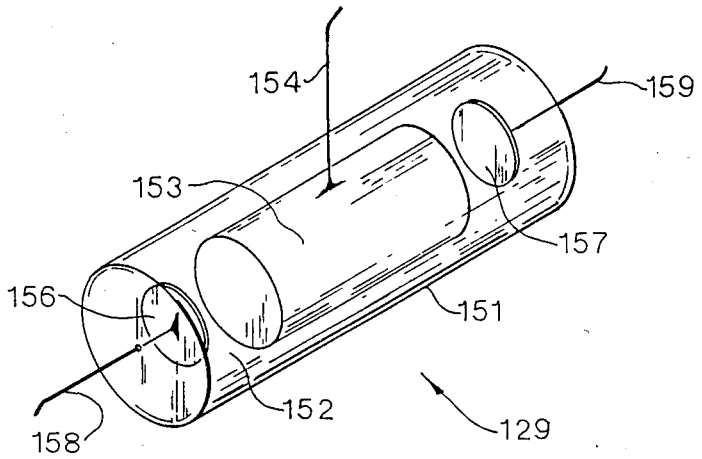
FIG. 8 is an isometric view of the pitch sensor of the device.

FIG. 8 is an isometric view of the transducer 129 of the invention. The transducer is housed in a glass envelope 151 which is partially filled with an electrolytic fluid 152. A conductive cylinder 153 is at the center of envelope 151 which is pierced with a connector 154 to cylinder 153. At either end are resistive pads 156, 157 which are, in turn, connected via electrodes 158, 159 respectively to differential amplifier 134 in FIG. 7. It is readily apparent that the resistance between electrodes 158, 159 and the common electrode 154 will vary differentially with the inclination of glass tube 151.

In operation the position of the drilling head is determined by above ground detectors which detect the dipole field strength and flux pattern to determine the tool's depth and direction. The detector will also pick up the amplitude modulation of the signal. The frequency of the amplitude modulation then may be used to determine the tool's pitch. For example, if V pitch is the signal's amplitude modulation and Wc is the transmitter frequency in radians/second and Wm is the modulation frequency in radians/second and m is the modulation index and since Wm is a function of pitch, we have the following relationship:

V pitch is proportional to $(1+m \cos WmT) \cos WcT$ which is equal to $\cos WcT+(m/2) \cos (Wc+Wm)T+(m/2) \cos (Wc-Wm) T$ Therefore, if for example $Wc \approx 5\times10^5$ radians/-second $Wc-Wm \lesssim 10^4$ radians/second or $Wc-Wm << Wc$ and since the terms $\cos (Wc+Wm)T$ and $\cos WcT$ can be easily filtered out, Wm can easily be determined.

The embodiments illustrated herein are illustrative only, the invention being definded by the subjoined claims.

I claim:

1. A method of installing a utility line comprising the steps of:

drilling a hole in the vicinity where the line is desired by means of a fluid jet which is advanced without rotation to drill a curved section and which is advanced with rotation to drill a straight section;

monitoring the progess of said drilling step;

applying correction to eliminate any deviation from the desired path;

reaming said hole drilled in said drilling step with a reamer provided with fluid jets; and, pulling said reamer back through the drilled reamed hole; and, towing the utility line through the drilled reamed hole with said reamer by connecting the utility line to the reamer.

2. The method of claim 1 wherein said monitoring step is accomplished by means of a radio transmission from the vicinity of said fluid jet to a receiver at the surface level.

3. The method of claim 1 further including the step of monitoring the pitch of said fluid jet drill.

4. The method according to claim 1 wherein said fluid jet is provided by means of a drilling apparatus including (a) a bendable, hollow drill string which has a front end and back end and which when maintained straight defines a straight, longitudinal axis;

(b) a nozzle assembly connected to the front end of said drill string and including a nozzle body having at least one jet orifice which is located at the front end of the assembly and which defines a jet flow axis disposed at an acute angle with respect to the longitudinal axis of said drill string when the latter is straight, said nozzle body having one outer side surface thereof which extends from the front of the nozzle assembly rearwardly to a limited extent in a fixed direction at an acute angle with the longitudinal axis of said drill string when the latter is straight, said outer side surface of said nozzle body being disposed above said orifice when said jet flow axis is angled downward;

(c) means for supplying high pressure fluid through said drill string and to said orifice for producing a fluid jet out of said orifice in the direction of said jet flow axis, and thereby at an acute angle with respect to said longitudinal axis;

(d) means for intermittently rotating said drill string and said nozzle assembly about the longitudinal axis of said drill string whereby to cause said fluid jet and said outer side surface of said nozzle body to rotate about said longitudinal axis; and (e) means for pushing said drill string and nozzle body in the forward direction in the presence of said fluid jet so as to cause the drill string and nozzle assembly including said angled fluid jet and said outer side surface of said nozzle body to move along a straight line path when said fluid jet is simultaneously rotated and so as to cause the drill string and nozzle assembly including said angled fluid jet and outer side surface to turn in the direction of said jet flow axis when said fluid jet is not rotating whereby said outer side surface because of its location relative to said orifice lies outside the turn as said nozzle assembly is caused to make a turn.

5. A method according to claim 4 wherein said nozzle body is connected to said drill string in a way which prevents the nozzle body from rotating relative to the drill string.

6. A method according to claim 5 wherein said nozzle body is connected to said drill string by means of a coupling assembly including a key and interconnecting slot.

7. A method of installing a utility line comprising the steps of:

drilling a hole in the vicinity where the line is desired by means of a fluid jet from a boring device which is advanced, in part, while being rotated about its own axis by means of a drill string connected at one end to the back end of the boring device and at its opposite end to a motor means for rotating the drill string and therefore the boring device; and, using a key and slot arrangement forming part of the boring device and part of the drill string, interlocking the boring device to the drill string so that the boring device will not rotate about its own axis relative to the drill string, whereby the boring device remains circumferentially aligned with the drill string.

8. A method according to claim 7 wherein said drill string includes a plurality of lengthwise sections which are interconnected together at adjacent ends thereof by means of cooperating key and slot arrangements identical to said first-mentioned key and slot arrangement.

9. An apparatus for drilling an underground passageway comprising:

(a) a bendable, hollow drill string which has a front end and a back end which when maintained straight defines a straight, longitudinal axis;

(b) a fluid jet producing nozzle assembly having a nozzle body connected to the front end of said drill string by means of a key and slot arrangement whereby to prevent the nozzle body from rotating relative to the drill string;

(c) means for supplying high pressure fluid through said drill string and to said nozzle assembly whereby to cause at least one fluid jet to flow from said nozzle assembly;

(d) means for intermittently rotating said drill string and said nozzle assembly about the longitudinal axis of said drill string; and (e) means for pushing said drill string and nozzle assembly in a forward direction.

10. An apparatus according to claim 9 wherein said drill string includes a plurality of lengthwise sections which are interconnected together at adjacent ends thereof by means of cooperating key and slot arrangements identical to said first-mentioned key and slot arrangement.

11. A method of drilling an undergound passageway comprising the steps of:

(a) providing a bendable, hollow drill string which has a front end and a back end and which when maintained straight defines a straight, longitudinal axis, and a nozzle assembly connected to the front end of said drill string and including a nozzle body having at least one jet orifice which is located at the front end of the assembly and which defines a jet flow axis disposed at an acute angle with respect to the longitudinal axis of said drill string when the latter is straight, said nozzle body having one outer side surface thereof which extends from the front of the nozzle assembly rearwardly to a limited extent in a fixed direction at an acute angle with the longitudinal axis of said drill string when the latter is straight, said outer side surface of said nozzle body being disposed above said orifice when said jet flow axis is angled downward;

(b) supplying high pressure fluid through said drill string and to said orifice for producing a fluid cutting jet out of said orifice in the direction of said jet flow axis, and thereby at an acute angle with respect to said longitudinal axis, whereby the fluid cutting jet serves to cut through the soil in front of said nozzle body;

(c) intermittently rotating said drill string and said nozzle assembly about the longitudinal axis of said drill string whereby to cause said fluid jet and said outer side surface of said nozzle body to rotate about said longitudinal axis; and pushing said drill string and nozzle body in the forward direction in the presence of said fluid jet so as to cause the drill string and nozzle assembly including said angled fluid jet and said outer side surface of said nozzle body to move along a straight line path when said fluid jet is simultaneously rotated and so as to cause the drill string and nozzle assemlby including said angled fluid jet and outer side surface to turn in the direction of said jet flow axis when said fluid jet is not rotating whereby said outer side surface becasue of its location relative to said orifice lies outside the turn as said nozzle assembly is caused to make a turn.

12. A method of drilling an underground passageway comprising the steps of:

(a) providing a bendable, hollow drill string which has a front end and a back end and which when maintained straight defines a straight, longitudinal axis and a nozzle assembly connected to the front end of said rill string and including a nozzle body having at least one jet orifice which is located at the front end of the assembly and which defines a jet flow axis disposed at an acute angle with respect to the longitudinal axis of said drill string when the latter is straight, said nozzle body having one outer side surface thereof which extends from the front of the nozzle assembly rearwardly to a limited extend in a fixed direction at an acute angle with the longitudinal axis of said drill string when the latter is straight, said outer side surface of said nozzle body being disposed above said orifice when said jet flow axis is angled downward;

(b) supplying high pressure fluid through said drill string and to said orifice for producing a fluid cutting jet out of said orifice in the direction of said jet flow axis, and thereby at an acute angle with respect to said longitudinal axis, whereby the fluid cutting jet serves to cut through the soil in front of said nozzle body;

(c) intermittently rotating said nozzle assembly about the longitudinal axis of said drill string whereby to cause said fluid jet and said outer side surface of said nozzle body to rotate about said longitudinal axis; and (d) pushing said drill string and nozzle body in the forward direction in the presence of said fluid jet so as to cause the drill string and nozzle assembly including said angled fluid jet and said outer side surface of said nozzle body to move along a straight line path when said fluid jet is simultaneously rotated and so as to cause the drill string and nozzle assembly including said angled fluid jet and outer side surface to turn in the direction of said jet flow axis when said fluid jet is not rotating whereby said outer side surface because of its location relative to said orifice lies outside the turn as said nozzle assembly is caused to make a turn.

13. A method of drilling an underground passageway comprising the steps of:

(a) providing bendable tubular means having a front end and a back end and which when maintained straight defines a straight, longitudinal axis, and a nozzle assembly connected to the front end of said tubular means and including a nozzle body having at least one jet orifice which is located at the front end of the assembly and which defines a jet flow axis disposed at an acute angle with respect to the longitudinal axis of said tubular means when the latter is straight, said nozzle body having one outer side surface thereof which extends from the front of the nozzle assembly rearwardly to a limited extend in a fixed direction at an acute angle with the longitudinal axis of said tubular means when the latter is straight, said outer side surface of said nozzle body being disposed above said orifice when said jet flow axis is angled downward;

(b) supplying high pressure fluid through said tubular means and to said orifice for producing a fluid cutting jet out of said orifice in the direction of said jet flow axis, and thereby at an acute angle with respect to said longitudinal axis, whereby the fluid cutting jet serves to cut through the soil in front of said nozzle body;

(c) intermittently rotating said nozzle assembly about the longitudinal axis of said tubular means whereby to cause said fluid jet and said outer side surface of said nozzle body to rotate about said longitudinal axis; and (d) pushing said tubular means and nozzle body in the forward direction in the presence of said fluid jet so as to cause the tubular means and nozzle assembly including said angled fluid jet and said outer side surface of said nozzle body to move along a straight line path when said fluid jet is simultaneously rotated and so as to cause the tubular means and nozzle assembly including said angled fluid jet and outer side surface to turn in the direction of said jet flow axis when said fluid jet is not rotating whereby said outer side surface because of its location relative to said orifice lies outside the turn as said nozzle assembly is caused to make a turn.

14. A method of installing a utility line comprising the steps of:

(a) drilling a hole in the vicinity where the line is desired by means of a drill string carrying a fluid jet which is advanced without rotation to drill a curved section and which is advanced with rotation to drill a straight section;

(b) monitoring the progress of said drilling step;

(c) applying correction to eliminate any deviation from the desired path;

(d) pulling said drill string back through the drilled hole; and towing the utility line through the drilled hole with said drill string by connecting the utility line to the drill string.

15. A nozzle assembly for use as a part of an apparatus for drilling an underground passageway by means of at least one high pressure fluid cutting jet, which apparatus includes bendable cable means for supporting said nozzle assembly at one end thereof, means for supplying high pressure fluid for said cutting jet, means for intermittently rotating said nozzle assembly about an axis which coincides with the longitudinal axis of cable means when the latter is straight, and means for urging the cable means and nozzle assembly in the forward direction, whereby to cause the nozzle assembly to move through the ground and turn in a controlled way at desired times, said nozzle assembly comprising:

a nozzle body having at least one jet orifice which is located at the front end of the assembly, which defines a jet flow axis disposed at an acute angle with respect to the longitudinal axis of said cable means when the latter is straight, and which is configured to be placed in fluid communication with said supply of high pressure fluid to produce said fluid cutting jet out of said orifice, said nozzle body having one outer side surface thereof which extends from the front of the nozzle assembly rearwardly to a limited extent in a fixed direction at an acute angle with the longitudinal axis of said cable means when the latter is straight, said outer side surface of said nozzle body being disposed above said orifice when the jet flow axis is angled downward, whereby when said nozzle assembly is caused to turn, said outer side surface because of its location relative to said orifice lies outside the turn and aids the nozzle assembly in making the turn.

16. A nozzle assembly according to claim 15 wherein said outer side surface is substantially parallel with said jet flow axis.

17. A nozzle assembly according to claim 15 wherein said nozzle body includes a second outer side surface which is located opposite said first mentioned outer side surface and which extends from the front of said nozzle assemlby rearwardly to a limited extent in a fixed direction substantially parallel with the longitudinal axis of said cable means when the latter is straight.

* * * * *